US006190271B1

(12) United States Patent
Rappaport et al.

(10) Patent No.: US 6,190,271 B1
(45) Date of Patent: Feb. 20, 2001

(54) APPARATUS FOR PROVIDING A CONTROLLED PROPULSION OF ELEMENTS TOWARD A RECEIVING MEMBER

(75) Inventors: Mark J. Rappaport, San Diego, CA (US); Jose E. Leal, Maynard, MA (US)

(73) Assignee: Sport Fun, Inc., Los Angeles, CA (US)

( * ) Notice: Under 35 U.S.C. 154(b), the term of this patent shall be extended for 0 days.

(21) Appl. No.: 09/231,195

(22) Filed: Jan. 14, 1999

(51) Int. Cl.[7] ..... A63B 69/00

(52) U.S. Cl. ..... 473/451; 473/422; 124/78; 434/247

(58) Field of Search ..... 473/415–422, 473/451–453; 221/86; 124/48, 49, 51.1, 6, 78, 31–34; 463/36; 434/247, 248, 252; 273/108.3

(56) References Cited

U.S. PATENT DOCUMENTS

| | | | | |
|---|---|---|---|---|
| 4,834,060 | * | 5/1989 | Greene | 124/78 |
| 4,915,384 | * | 4/1990 | Bear | 473/451 |
| 5,044,350 | * | 9/1991 | Iwabuchi et al. | 124/51.1 |
| 5,056,783 | * | 10/1991 | Matcovich elt al. | 473/453 |
| 5,160,131 | * | 11/1992 | Leon | 473/451 |
| 5,464,208 | * | 11/1995 | Pierce | 473/451 |
| 5,741,182 | * | 4/1998 | Lipps et al. | 463/36 |
| 5,748,797 | * | 5/1998 | Sunseri et al. | 473/451 |
| 5,833,549 | * | 11/1998 | Zur et al. | 473/453 |
| 5,868,578 | * | 2/1999 | Baum | 434/247 |

* cited by examiner

*Primary Examiner*—Stephen F. Gerrity
*Assistant Examiner*—Mitra Aryanpour
(74) *Attorney, Agent, or Firm*—Ellsworth R. Roston; Fulwider Patton Lee & Utecht, LLP

(57) ABSTRACT

A member (e.g. baseball bat) includes a switch manually operable to obtain the transmission of signals by a transmitter in the member to an apparatus for propelling an element (e.g. ball) toward an individual holding the member. The apparatus includes a receiver for receiving the transmitted signals and includes a housing with a hollow passage. A ramp supported on the housing holds a plurality of the elements for sequential movement into the passage. The element in the passage is supported on one of the fingers of a rotary detainer. The detainer is normally prevented from rotating by a release mechanism coupled to the detainer. The detainer is rotated by the weight of the element when the release mechanism is decoupled from the detainer upon the reception of the transmitted signals. The element then moves downwardly in the passage to a propulsion mechanism which may comprise a pair of rollers for gripping the opposite ends of the element. The rollers are actuated by motors connected in a circuit with a transportable energy source (e.g. battery) so that the motors are energized only when a ball is disposed on a finger in the detainer, thereby prolonging battery life. The element is propelled by the propulsion mechanism toward the individual holding the member so that the individual can practice receiving the element (e.g. hitting the ball). The trajectory of the propelled ball can be adjusted by pivoting the housing relative to a base member which supports the housing and which holds the battery.

42 Claims, 5 Drawing Sheets

APPARATUS FOR PROVIDING A CONTROLLED PROPULSION OF ELEMENTS TOWARD A RECEIVING MEMBER

This invention relates to apparatus for providing an individual with an opportunity to practice receiving an element. For example, the invention relates to apparatus which propels balls toward a batter so that the batter can practice hitting the propelled balls. The invention is particularly advantageous because the batter can control when the ball is propelled toward the hitter.

BACKGROUND OF THE INVENTION

Many youngsters are interested in improving their skills in hitting a baseball. Because of this, machines have been provided on a commercial basis for pitching balls to a batter. The batter positions himself or herself in a batting cage and the machine then transmits a plurality of balls in sequence to the batter. The batter pays for this by inserting coins into a coin box or by paying a cashier.

There are at least three (3) problems with the arrangement described in the previous paragraph. One problem is that the batter cannot control when successive balls are propelled to the batter by the pitching machine. Another problem is that the batter has to travel to the site of the pitching machine. This is an inconvenience to the batter. A third disadvantage is that the pitching machines propel the balls at a high velocity toward the batter. This may be advantageous to teenagers and adults but it is not advantageous to pre-teenagers.

BRIEF DESCRIPTION OF THE INVENTION

This invention provides an apparatus for overcoming the disadvantages discussed in the previous paragraph. The apparatus of this invention provides for a control by an individual (e.g. a batter) for times when a machine propels an element (e.g. a ball) for operation of a member (e.g. a bat) by the individual (e.g. batter). The apparatus of this invention is portable even by pre-teenagers so that the individual operating the member (e.g. the bat) can practice anywhere including the individual's backyard or a friend's backyard. The apparatus of this invention is especially designed to be used by pre-teenagers.

Although a pitching machine is shown in the drawings to be a preferred embodiment of the invention, it will be appreciated by persons of ordinary skill in the art that other embodiments are within the scope of the invention. For example, the apparatus of this invention can be adapted to propel hockey pucks to a player holding a hockey stick or to propel lacrosse balls to a player holding a lacrosse stick.

In one embodiment of the invention, a member (e.g. baseball bat) includes a switch manually operable to obtain the transmission of signals from a transmitter in the member to the apparatus which propels for propelling an element (e.g. ball) toward an individual holding the member.

The apparatus includes a receiver for receiving the transmitted signals and includes a housing with a hollow passage. A ramp supported on the housing holds a plurality of the elements for sequential movement into the passage. The element in the passage is supported on one of the fingers of a rotary detainer. The detainer is normally prevented from rotating by a release mechanism coupled to the detainer.

The detainer is rotated by the weight of the element when the release mechanism is decoupled from the detainer upon the reception of the transmitted signals. The element then moves downwardly in the passage to a propulsion mechanism which may comprise a pair of rollers for gripping the opposite ends of the element. The rollers are actuated by motors connected to a circuit with a transportable energy source (e.g. battery) so that the motors are energized only when a ball is disposed on a finger in the detainer, thereby prolonging battery life.

The element is propelled by the propulsion mechanism toward the individual holding the member so that the individual can practice receiving the element (e.g. hitting the ball). The trajectory of the propelled ball can be adjusted by pivoting the housing relative to a base member which supports the housing and which holds the battery.

DETAILED DESCRIPTION OF THE INVENTION

Figure 1:
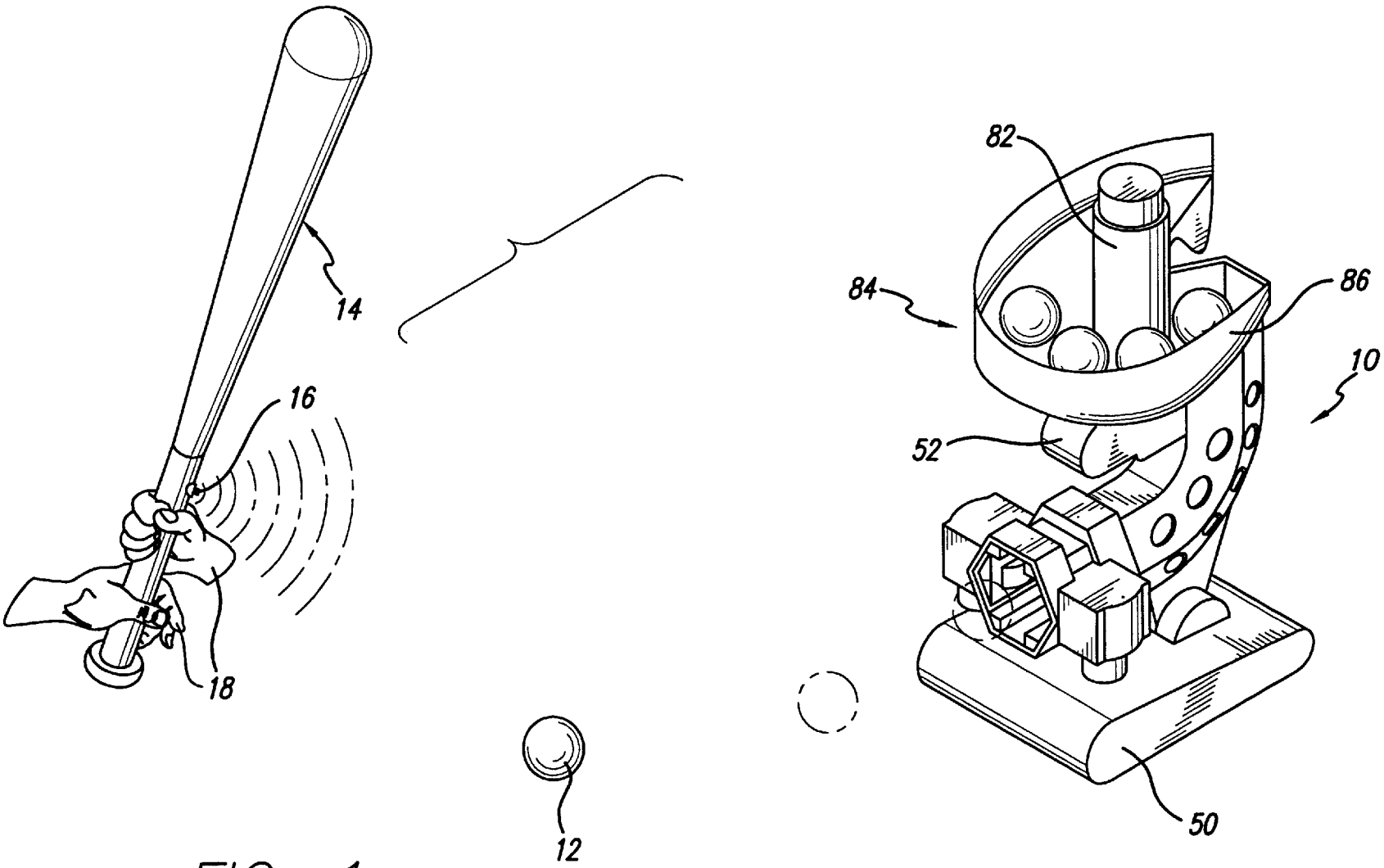
FIG. 1 is a perspective view of (1) a baseball bat and the hands of an individual swinging the bat to hit a ball propelled toward the bat, (2) pitching apparatus for propelling the ball toward the bat and (3) the movement of the ball from the pitching apparatus toward the bat.

In one embodiment of the invention, apparatus generally indicated at 10 (FIG. 1) is provided for propelling a ball 12 toward a bat generally indicated at 14. The ball 12 may be a hard or a soft ball generally provided for baseball games. Preferably the ball is a hollow plastic ball having a light weight and constructed to limit the speed of the ball and the distance of travel of the ball. This ball is advantageous when the hitter is a child generally less than ten (10) years old.

A switch 16 (FIG. 4) is provided on the bat 14, preferably at a position above the positions on the handle portion where the batter's hands 18 grip the bat when the batter is swinging at the ball 12. The switch 16 is depressed by the batter when the batter desires to have the apparatus 10 propel the ball 12 toward the batter.

Figure 5:
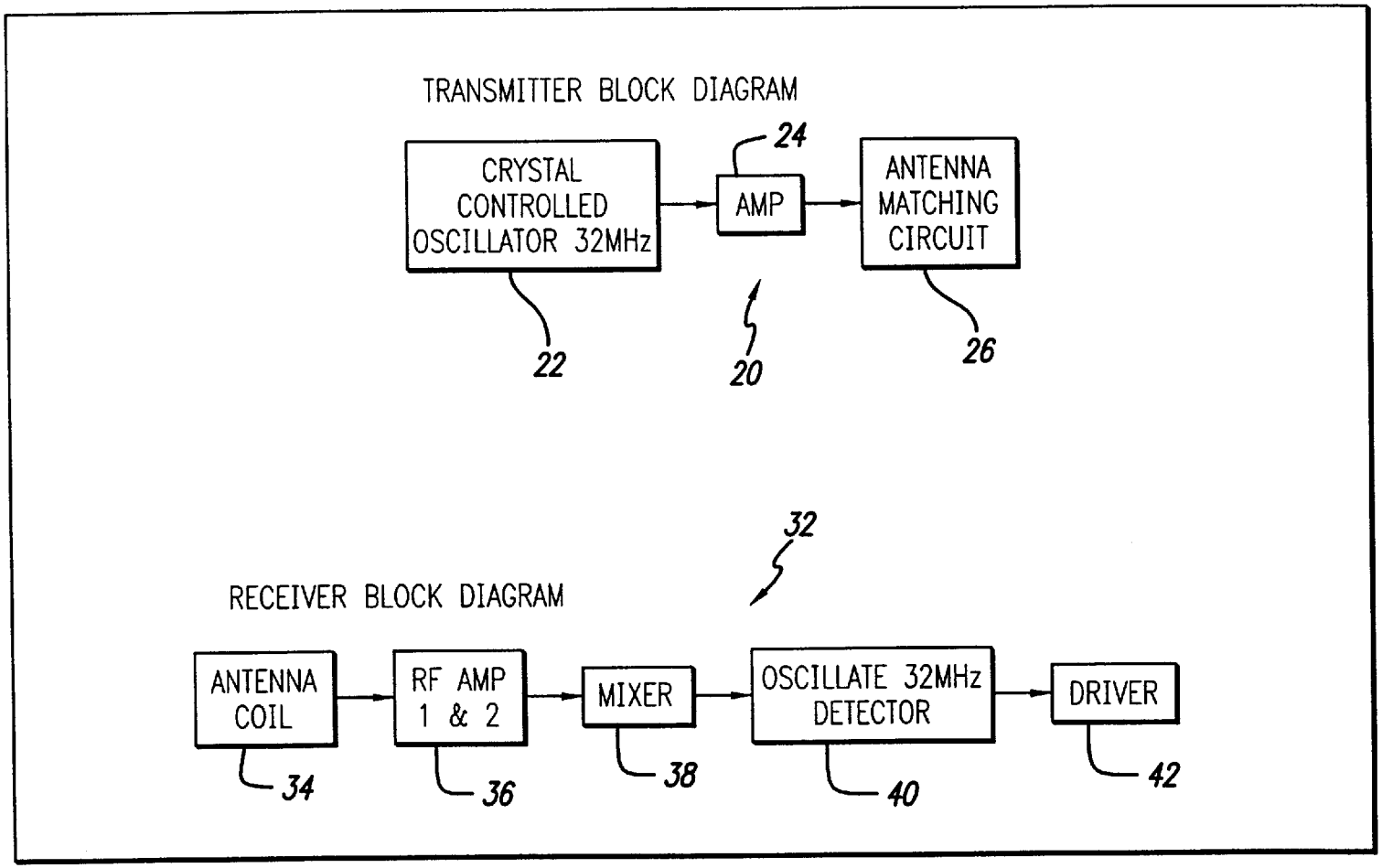
FIG. 5 shows a block diagram of a transmitter in the bat for transmitting signals to the pitching apparatus and a block upon the closure of the switch in FIG. 4 and a block diagram of a receiver in the pitching apparatus for receiving the signals transmitted from the bat and for activating the pitching machine to propel a ball toward the bat.

A transmitter generally indicated at 20 in FIG. 5 is disposed in the bat 14 to transmit signals to the pitching apparatus 10 for obtaining the propulsion of the ball 12 by the pitching apparatus toward the bat 14. In one embodiment, the transmitter 20 may include an oscillator 22 for producing signals at a particular frequency such as approximately thirty-two megahertz (32 MHz). The oscillator 22 may be crystal controlled.

The signals from the oscillator 22 may be amplified at 24 and the amplified signals may be introduced to an antenna 26 which may be provided with an impedance preferably matching the impedance of the amplifier 24. An energy source such as a battery 28 (FIG. 4) may be removably disposed in the bottom 30 of the bat to energize the transmitter 20. Since the signals are transmitted by the antenna 26, they are transmitted on a wireless basis.

A receiver generally indicated at 32 in FIG. 5 may be disposed in the pitching apparatus 10 to receive the signals transmitted from the bat 14. The receiver 32 may include an antenna 34 which may be in the form of a coil. Since the receiver 32 includes an antenna 34, the signals are received on a wireless basis by the receiver. Amplifiers 36 may be provided to amplify the received signals. The amplified signals may then be mixed at 38 and the mixed signals may then be detected at 40 to recover the signals at thirty-two megahertz (32 MHz). The detected signals may then be introduced to a driver 42.

Figure 2:
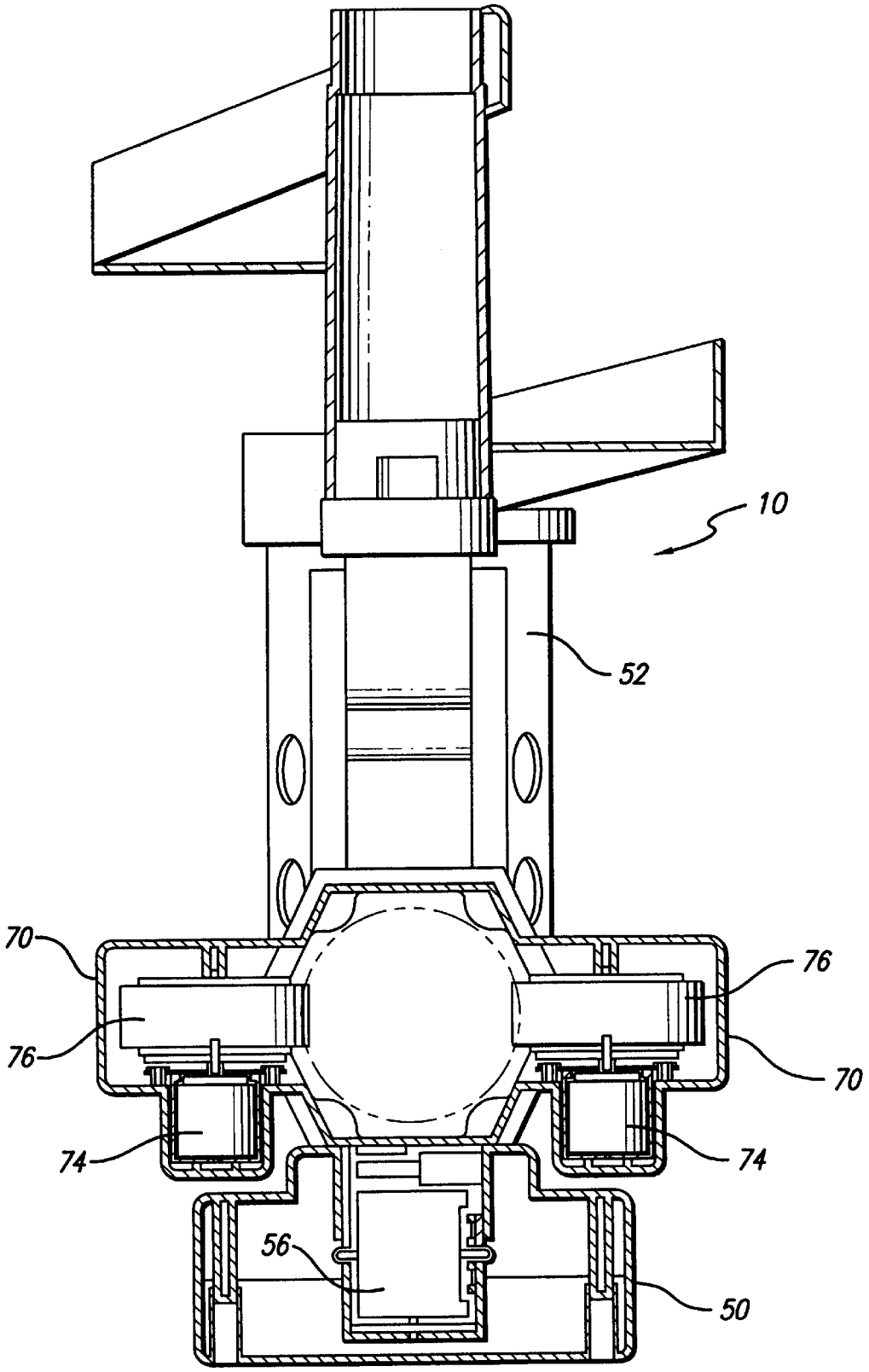
FIG. 2 is a sectional view in elevation of the pitching apparatus shown in FIG. 1 as seen from a position in front of the apparatus.
Figure 3:
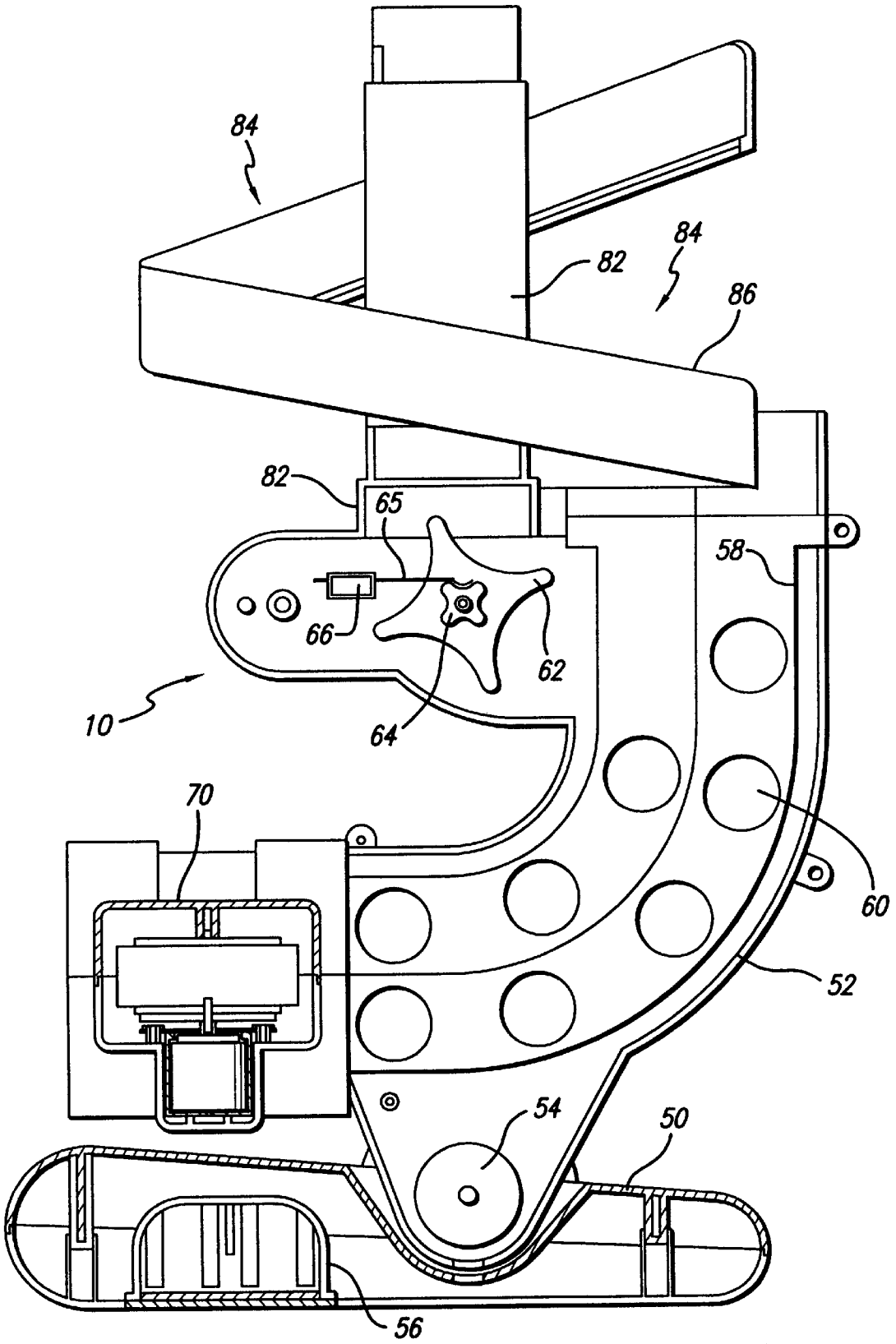
FIG. 3 is an elevational view, partially in section, of the pitching apparatus as seen from a position to one side of the apparatus.

The apparatus 10 includes a base member 50 (FIGS. 1–3) and a housing 52 pivotably attached on a horizontal axis to the base member as at 54. The base member is adapted to be supported on a support surface such as the ground. The base member 54 is adapted to hold a transportable energy source such as a battery 56.

The housing 52 is provided with a hollow passage 58. Holes 60 may be provided in the housing 52 at progressive positions along the passage 58, primarily for aesthetic purposes. The ball 12 is adapted to be disposed in the hollow passage 58 against a plurality of annularly spaced fingers 62 in a rotatable detainer 64 disposed in the housing 52 and having a shape such as a star wheel. The detainer 64 is normally engaged by a release mechanism 65 which is actuated to be withdrawn from engagement with the detainer when a solenoid 66 is energized.

The hollow passage 58 is initially disposed vertically and is progressively curved at progressive downward positions to have a horizontal disposition. A pair of pockets 70 are disposed in the housing 52 at the opposite sides of the housing at positions where the hollow passage 58 is substantially horizontal. A pair of motors 74 and a pair of actuators such as rollers 76 are provided.

The motor 74 and the roller 76 in each individual one of the pocket 70 are operatively coupled to each other to provide a rotation of the roller in accordance with the energizing of the motor. The rollers 76 are preferably made from a resilient material and are preferably extended into the hollow passage 58 to grip the opposite ends of the ball 12 in the passage and to propel the ball from the passage in accordance with the rotation of the rollers. The motors 74 and the rollers 76 may be considered as a propulsion mechanism.

Figure 6:
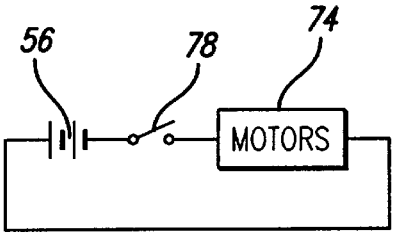
FIG. 6 is a schematic diagram of an electrical circuit for energizing motors in the pitching apparatus when a ball is disposed in the pitching apparatus, thereby providing for the propulsion of the ball from the pitching apparatus when the receiver receives signals from the transmitter.

The battery 56 and the motors 74 are disposed in a series circuit (FIG. 6) with a normally open switch 78. The switch 78 becomes closed when the ball 12 is disposed on one of the fingers 62 of the detainer 64. The closure of the switch 78 at such time results from the fact that each finger 62 has some play in its positioning. This causes each finger 62 to be disposed upwardly, with no ball on the finger, from the position which it occupies when the ball 12 is disposed on the finger. In the upward position of the finger 62, the switch 78 is open.

In this way, the motors 74 are energized only when the ball 12 is in the hollow passage 58 in a position to be propelled from the hollow passage when a signal from the transmitter 20 is received by the receiver 32. Furthermore, energy is conserved in the battery 56 to prolong the life of the battery since the battery provides energy to the motors 74 only when the ball 12 is disposed in the hollow passage 58.

The housing 52 is provided at its top end with a stanchion. A tube 82 forming part of a ramp generally indicated at 84 fits snugly on the stanchion in a removable relationship to the stanchion. The ramp 84 defines an inclined track 86 extending in a spiral path to a position at its bottom end above the hollow passage 58. A plurality of the balls 12 are disposed on the track 86 for a movement of each ball in sequence into the hollow passage 58 when the ball previously in the hollow passage is propelled by the rollers 76 from the passage toward the batter holding the bat 14.

Assume that the ramp 84 is disposed on the stanchion at the top of the housing 52 and that one of the balls 12 on the track 86 has dropped into the hollow passage 58 for disposition on the finger 62 extending into the hollow passage. This causes the finger 62 on the detainer 64 to be positioned to close the switch 78 in FIG. 6 and the motors 74 to be energized. The resultant rotation of the rollers 76 provides for the propulsion of the ball from the hollow passage 58 when the ball is released by the detainer 64.

Figure 4:
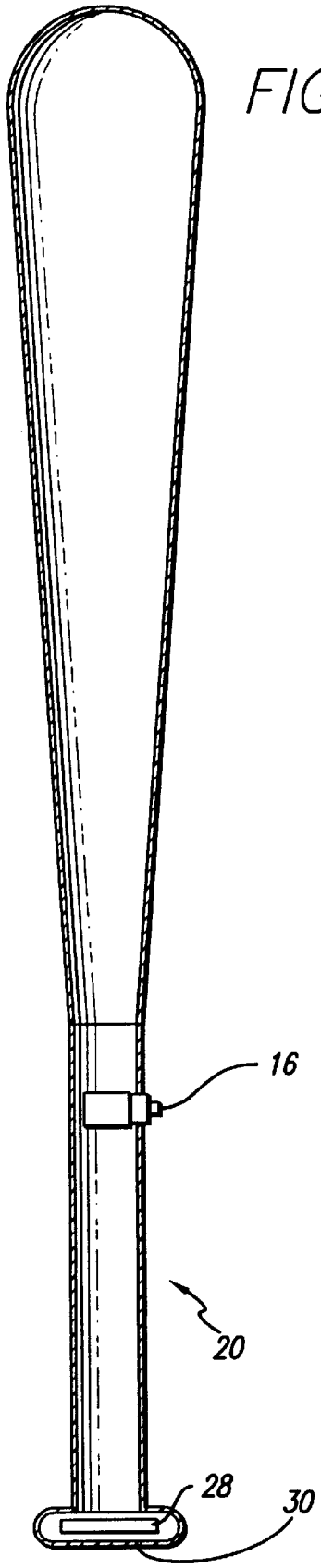
FIG. 4 is an enlarged sectional view in elevation of the bat and includes a switch manually operable to provide for a transmission of signals from the bat to the pitching apparatus.

When the batter manually closes the switch 16 in FIG. 4, signals are transmitted by the transmitter 20 in FIG. 5 to the receiver 32 in FIG. 5. This causes the solenoid 66 (FIG. 3) to be energized and the release mechanism 65 to be retracted from the detainer 64. The detainer 64 is now free to be rotated in a counterclockwise direction by the ball 12 on the finger 62. This rotation frees the ball 12 to move downwardly in the hollow passage 58 to a position between the rollers 76. Since the rollers 76 are already being rotated by the motors 74, the rollers propel the ball 12 from the hollow passage toward the batter when the ball reaches the rollers. At the same time that the ball 12 is dropping through the hollow passage 58, the next ball on the track 86 drops into the hollow passage for disposition against one of the fingers 62.

The apparatus described above has been disclosed with reference to a pitching machine for baseball. It is believed that a person of ordinary skill in the art will be able with little or no experimentation to adapt the apparatus for other uses. For example, it is believed that a person of ordinary skill in the art will be able to adapt the invention for use by a hockey player or for use by a lacrosse player.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the claims.

What is claimed is:

1. In combination for propelling an element, a member having an outer periphery constructed to receive the propelled element and manually operable to impose a force by the member against the element for propelling the element, and an apparatus for propelling the element toward the member for the manual operation of the member to impose the force on the member, the apparatus being separated from the member, the member including a switch actuatable from the outer periphery of the member and a signal transmitter disposed in the member and normally not energized and energizable in response to an actuation of the switch, before a propulsion of the element from the apparatus and before any movement of the member to strike the element, to send signals on a wireless basis to the apparatus for obtaining the propulsion of the element from the apparatus, and the apparatus including a receiver, normally inoperative disposed in the apparatus for receiving the signals on a wireless basis from the member, the apparatus being constructed to hold the element and being inoperative until the reception of the signals on the wireless basis by the receiver from the member and being operative upon the reception of the signals on the wireless basis by the receiver from the member to release the element for propulsion toward the member and to propel the element toward the member.

2. In a combination as set forth in claim 1, the apparatus, including a hollow passage for holding the element and including a propulsion mechanism for propelling the element from the hollow passage toward the member and including a releasable detainer for holding the element within the hollow passage in decoupled relationship to the propulsion mechanism, the detainer being responsive to the signals received by the receiver from the member for releasing the element to the propulsion mechanism for propulsion by the propulsion mechanism through the hollow passage toward the member.

3. In a combination as set forth in claim 2 wherein the propulsion mechanism includes an actuator and a motor for operating the actuator and wherein the motor is energized when the element has been released by the detainer.

4. In a combination as set forth in claim 2 wherein the propulsion mechanism includes rollers for gripping the element at opposite ends of the element and for rotating the element to propel the element from the hollow barrel and wherein the rollers are energized when the element is released by the detainer.

5. In a combination as set forth in claim 2, a housing, a ramp supported by the housing for holding a plurality of the elements in a stacked relationship to obtain a sequential introduction of the stacked elements into the housing in accordance with the sequential propulsion of the stacked elements from the housing toward the member.

6. In a combination as set forth in claim 5, a base member pivotably coupled to the housing on a horizontal axis for providing a pivotable adjustment vertically in the position of the housing relative to the base member for providing an adjustment in the trajectory of each of the stacked elements in accordance with the pivotal adjustments in the position of the housing relative to the base member, the hollow passage, the propulsion mechanism and the releasable detainer being disposed in the housing.

7. In a combination as set forth in claim 1 wherein the element is a ball and the member is a baseball bat and the apparatus pitches the ball toward the baseball bat.

8. In a combination as set forth in claim 1 wherein the propulsion mechanism includes rollers for gripping the element at opposite ends of the element after the release of the element by the detainer and for rotating the element to propel the element from the propulsion mechanism toward the member.

9. In a combination as set forth in claim 1, the apparatus including structure for holding a plurality of elements in a stacked relationship and for releasing the elements sequentially from the stacked relationship in accordance with the reception by the receiver of successive signals from the transmitter upon successive actuations of the switch on the member and for propelling the released elements from the apparatus toward the member.

10. In a combination as set forth in claim 1, wherein an antenna is provided to receive the signals from the transmitter and to transmit the signals on the wireless basis to the receiver.

11. In a combination as set for in claim 1, wherein a battery is disposed in the member to energize the transmitter in the member.

12. In combination for propelling an element, a member having an external periphery and manually operable to impose a force against the element, the member including a switch manually operable from the external periphery of the member and having first and second states of operation and being normally disposed in the first state of operation and being manually operable from the external periphery of the member to the second state of operation before any movement of the member to impose a force against the element, and including a transmitter disposed in the member and inoperable with the switch in the first state of operation and responsive to the manual operation of the switch to the second switch of operation to transmit signals, and an apparatus separated from the member and including a receiver disposed in the apparatus and normally inoperative and operative to receive the signals on the wireless basis from the transmitter and including a propulsion mechanism normally inoperative and responsive to the signals received on the wireless basis by the receiver from the transmitter to propel the element toward the manually operable member to obtain an imposition by the member of the force against the element.

13. In a combination as set forth in claim 12, the apparatus being constructed to receive the element and including a battery connected in an electrical circuit with the propulsion mechanism, upon the receipt of the signals by the receiver in the apparatus, to energize the propulsion mechanism for propelling the element toward the manually operated member.

14. In a combination as set forth in claim 12, the apparatus including a hollow passage for receiving the element and including a detainer disposed in the hollow passage for detaining the element within the hollow passage and including a release mechanism responsive to the signals received by the receiver from the member for operating upon the detainer to provide for a release of the element by the detainer from the hollow passage and for a propulsion of the element by the propulsion mechanism from the hollow passage toward the member.

15. In a combination as set forth in claim 14 wherein the detainer has first and second positions and wherein the detainer is disposed in the first position to prevent the element from being propelled from the hollow passage and wherein the detainer is disposed in the second position to provide for the propulsion of the element from the hollow passage and wherein a battery is provided in the apparatus and wherein the propulsion mechanism is electrically decoupled from the battery with the detainer in the first position and is electrically coupled to the battery with the detainer in the second position to provide for a propulsion of the element by the propulsion mechanism from the hollow passage.

16. In a combination as set forth in claim 15 wherein the detainer includes a star wheel with a plurality of fingers disposed at progressive annular positions on the star wheel and wherein each finger retains the element within the hollow passage and wherein the release mechanism operates to rotate the star wheel for a release of the element and for a propulsion of the element from the hollow passage by the propulsion mechanism.

17. In a combination as set forth in claim 16 wherein the element is a ball and the manually operated member is a baseball bat and the apparatus propels the ball toward the baseball bat.

18. In a combination as recited in claim 15, the battery being disposed in the base member, an inclined ramp constructed to hold a plurality of the elements in an inclined and stacked relationship and disposed relative to the hollow passage for sequentially introducing the elements on the ramp into the hollow passage in accordance with the sequential propulsion of the elements from the passage, a housing for the detainer and the release mechanism, the hollow passage being disposed in the housing, and a base member pivotably coupled to the housing for vertically adjusting the position of the housing relative to the base member to adjust the trajectory of the element propelled from the housing.

19. In a combination as recited in claim 14, an inclined ramp constructed to hold a plurality of the elements in an inclined and stacked relationship and disposed relative to the hollow passage for sequentially introducing the elements on the ramp into the hollow passage in accordance with the sequential propulsion of the elements from the hollow passage.

20. In a combination as set forth in claim 14, a housing for the detainer and the release mechanism, the hollow passage being disposed in the housing, and a base member pivotably coupled to the housing for adjusting the position of the housing on a horizontal axis in a vertical direction relative to the base member to adjust the trajectory of the element propelled from the housing.

21. In a combination as set forth in claim 12, the apparatus being constructed to hold a plurality of the elements and to propel the elements sequentially from the apparatus toward the member in accordance with successive manual operations of the switch on the manually operable member.

22. In a combination as set forth in claim 12, wherein an antenna receives the signals from the transmitter and transmits the signals on the wireless basis to the receiver.

23. In a combination as recited in claim 22, wherein a battery is disposed in the member to energize the transmitter.

24. In combination, a member manually operable to provide signals on a wireless basis for obtaining a propulsion of an element toward the member and to impose a force against the element for propelling the element, a housing, a receiver disposed in the housing for receiving the signals transmitted on the wireless basis from the manually operable member, there being a hollow passage in the housing for receiving the element, a detainer disposed in the housing and movable between first and second positions in accordance with the disposition of the element in the hollow passage and normally operable in the first position to retain the element in the hollow passage and actuatable to the second position to provide for a release of the element by the detainer for a movement of the element through the hollow passage, a release mechanism disposed in the housing and responsive to the signals received on the wireless basis by the receiver from the manually operable member to actuate the detainer from the first position to the second position, and a propulsion mechanism disposed in the housing for propelling the element from the hollow passage toward the manually operable member when the element is released by the detainer upon the actuation of the detainer from the first position to the second position.

25. In a combination as set forth in claim 24, a source of energy, and an electrical circuit including the source of energy and the propulsion mechanism for operating the propulsion mechanism to provide for the propulsion of the element from the hollow passage when the element is released by the detainer in the second position of the detainer.

26. In a combination as set forth in claim 25 wherein the propulsion mechanism includes a motor energizable in response to the actuation of the detainer to the second position to obtain the propulsion of the element by the propulsion mechanism from the hollow passage and wherein the detainer is a star wheel with a plurality of annularly spaced fingers and wherein the element is retained in the hollow passage by one of the fingers in the first position of the detainer and wherein the detainer is rotated by the release mechanism to the second position upon the reception by the receiver of the signals from the manually operable member and wherein the element is released for movement through the hollow passage during the rotation of the detainer to the second position.

27. In a combination as set forth in claim 26, a base member, the source of energy being disposed in the base member, the housing being pivotably coupled to the base member on a horizontal axis to adjust vertically the trajectory of the element propelled by the propulsion mechanism toward the manually operable member.

28. In a combination as set forth in claim 27 wherein the propulsion mechanism includes a motor energizable in response to the actuation of the detainer to the second position to obtain the propulsion of the element by the propulsion mechanism from the hollow passage, and a ramp disposed on the housing for holding a plurality of the elements in a stacked relationship and for directing the elements in sequence to the hollow passage in the housing.

29. In a combination as set forth in claim 6 wherein the propulsion mechanism includes a motor energizable in response to the actuation of the detainer to the second position to obtain the propulsion of the element by the propulsion mechanism from the hollow passage.

30. In a combination as set forth in claim 6 wherein the detainer is a star wheel with a plurality of annularly spaced fingers and wherein the element is retained in the hollow passage by one of the fingers in the first position of the detainer and wherein the detainer is rotated by the release mechanism to the second position when the receiver receives the signals from the manually operable member and wherein the element is released for movement through the hollow passage during the rotation of the detainer to the second position.

31. In a combination as set forth in claim 24, a base member, the housing being pivotably coupled to the base member on a horizontal axis to adjust vertically the trajectory of the element propelled by the propulsion mechanism toward the manually operable member.

32. In combination, a member manually operable to provide signals on a wireless basis for obtaining a propulsion of an element toward the member and to impose a force against the element for propelling the element, a housing, a receiver disposed in the housing for receiving the signals on the wireless basis from the manually operable member, a detainer disposed in the housing for retaining the element against movement of the element toward the manually operable member, a release mechanism disposed in the housing in cooperative relationship with the detainer and responsive to the signals received on the wireless basis by the receiver from the manually operable member for operating upon the detainer to provide a release of the element by the detainer when the receiver receives the signals on the wireless basis from the manually operable member, and a propulsion mechanism disposed in the housing and responsive to the release of the element by the detainer for propelling the element toward the manually operable member.

33. In a combination as set forth in claim 22, a source of energy disposed in an electrical circuit with the propulsion mechanism to energize the propulsion mechanism for propelling the element toward the manually operable member when the receiver receives the signals from the manually operable member.

34. In a combination as set forth in claim 33, a ramp disposed on the housing in a cooperative relationship with the detainer for holding a plurality of the elements for a sequential passage of each of the elements into the housing to a position for retention of the element by the detainer against movement toward the manually operable member until the element previously in the housing has been propelled by the propulsion mechanism toward the manually operable member.

35. In a combination as set forth in claim 22, a base member, the housing being pivotably coupled to the base member on a horizontal axis to adjust vertically the trajectory of the element propelled by the propulsion mechanism toward the manually operable member.

36. In a combination as set forth in claim 22, the source of energy constituting a battery and being disconnected from the propulsion mechanism until the time that a signal is received by the receiver from the manually operable member.

37. In a combination as set forth in claim 22, a base member, a source of energy releasably disposed in the base member for activating the propulsion mechanism when a signal is received by the receiver from the manually operable member, and the housing being pivotably coupled to the base member on a horizontal axis to adjust vertically the trajectory of the element propelled by the propulsion mechanism from the housing.

38. In combination, a member including a switch disposed on the member and manually operable to activate a transmitter disposed in the member for providing signals on a wireless basis for obtaining a propulsion of an element toward the member, the member being manually operable to impose a force against the element for propelling the element when the element is propelled toward the member, a housing, a receiver disposed in the housing for receiving the signals transmitted on the wireless basis by the transmitter in the member, a detainer disposed in the housing for retaining the element against movement from the housing and responsive to the signals received by the receiver on the wireless basis from the member for releasing the element for movement from the housing, and a propulsion mechanism disposed in the housing and responsive to the release of the element by the detainer for propelling the element toward the manually operable member.

39. In a combination as set forth in claim 38, a ramp disposed above the housing for holding a plurality of the elements in a stacked relationship and constructed to provide a movement of each of the stacked elements in a sequence into the housing to a position for the retention of the element by the detainer when the element previously in the position for retention by the detainer has been released by the detainer.

40. In a combination as set forth in claim 38, a base member, a source of electrical energy disposed in the base member, and the housing being pivotably coupled to the base member on a horizontal axis to adjust vertically the trajectory toward the manually operable member of the element propelled by the member.

41. In a combination as set forth in claim 38, including, a source to energize the propulsion mechanism when the element has been released by the detainer for movement toward the propulsion mechanism.

42. In a combination as set forth in claim 38 wherein the propulsion mechanism includes rollers for gripping the element at opposite ends of the element and for rotating the element to propel the element from the housing and wherein the rollers are energized when the element is released by the detainer.

* * * * *

UNITED STATES PATENT AND TRADEMARK OFFICE

CERTIFICATE OF CORRECTION

PATENT NO. : 6,190,271B1
DATED : February 20, 2001
INVENTOR(S) : Mark J. Rappaport, Jose E. Leal It is certified that error appears in the above-identified patent and that said Letters Patent is hereby corrected as shown below:

Column 1,
Line 37, delete "a" following "for".

Column 2,
Line 60, change "depressed", to read -- pressed --.

Column 8, claim 29,
Line 65, change "6", to read -- 24 --.

Column 9, claim 30,
Line 3, change "6", to read -- 24 --.

Column 9, claim 33,
Line 45, change "22", to read -- 32 --.

Column 9, claim 35,
Line 61, change "22", to read -- 32 --.

Column 10, claim 36,
Line 1, change "22", to read -- 32 --.

Column 10, claim 37,
Line 6, change "22", to read -- 32 --.

Signed and Sealed this

Sixth Day of November, 2001

*Attest:*

Nicholas P. Godici

NICHOLAS P. GODICI
*Acting Director of the United States Patent and Trademark Office*

*Attesting Officer*